US006769796B1

(12) United States Patent
Trammell

(10) Patent No.: US 6,769,796 B1
(45) Date of Patent: Aug. 3, 2004

(54) COLLAPSIBLE DECORATIVE STAR

(76) Inventor: Melvin G. Trammell, 7114 Lake Van Dr., Dexter, NM (US) 88230

( * ) Notice: Subject to any disclaimer, the term of this patent is extended or adjusted under 35 U.S.C. 154(b) by 0 days.

(21) Appl. No.: 10/394,332

(22) Filed: Mar. 21, 2003

Related U.S. Application Data

(60) Provisional application No. 60/366,329, filed on Mar. 21, 2002.

(51) Int. Cl.[7] ..... F21V 17/00

(52) U.S. Cl. ..... 362/450; 362/252; 362/250; 362/121; 362/807; 428/12; 248/165

(58) Field of Search ..... 362/121, 806–808, 362/450, 252, 431, 250; 428/8, 9, 12; 248/165, 166

(56) References Cited

U.S. PATENT DOCUMENTS 2,894,345 A * 7/1959 Bushnell ..... 362/121
2,911,748 A * 11/1959 Rodgers ..... 211/200
3,184,366 A * 5/1965 Claude ..... 428/12
3,704,367 A * 11/1972 Korb ..... 362/121
3,819,457 A * 6/1974 Mottel ..... 428/9
3,846,213 A * 11/1974 Thiemann ..... 428/9
6,179,442 B1 1/2001 Schurle
6,273,583 B1 8/2001 Trisler
6,607,284 B1 * 8/2003 Tsai ..... 362/121

* cited by examiner

*Primary Examiner*—Alan Cariaso
*Assistant Examiner*—Ali Alavi
(74) *Attorney, Agent, or Firm*—Rod D. Baker; Peacock, Myers & Adams, P.C.

(57) ABSTRACT

A collapsible decorative device. There is disclosed a multi-component apparatus for erecting an aesthetically pleasing star-shaped frame upon which lights, paper, fabric or even fireworks may be draped, attached, covered or arranged to provide a rigid star decoration. Both five- and six-pointed star versions are disclosed. The elements of the device are variously and pivotally interconnected, so that the device may be compactly collapsed for transportation or storage, and yet is easily collapsed and re-erected for repeated use from holiday to holiday.

16 Claims, 15 Drawing Sheets

COLLAPSIBLE DECORATIVE STAR

CROSS-REFERENCE TO RELATED APPLICATIONS

This application claims the benefit of the filing of U.S. Provisional Patent Application Serial No. 60/366,329, entitled "Collapsible Decorative Star", filed on Mar. 21, 2002, and the specification thereof is incorporated herein by reference.

BACKGROUND OF THE INVENTION

1. Field of the Invention (Technical Field)

The present invention relates to decorations, particularly patriotic and holiday decorations, and specifically to a star-shaped decoration that is collapsible for transport and storage, yet durable and re-useable.

2. Background Art

Previous decorative stars are generally made of paper or cardboard, which are less than durable, sometimes not rigid (especially for outdoor use), often not re-useable from year-to-year, and may even pose fire hazards. Known star decorations that purport to overcome the problems of durability and rigidity typically are not readily and easily collapsible for transport and storage, or are difficult to re-assemble at the beginning of a new season of use. U.S. 6,273,583 to Trisler and U.S. Pat. Nos. 6,179,442 to Schurle typify the state of the art in this field of endeavor.

SUMMARY OF THE INVENTION (DISCLOSURE OF THE INVENTION)

The invention relates to collapsible decorative devices. There is disclosed a multi-component apparatus for erecting an aesthetically pleasing star-shaped frame upon which lights, paper, fabric or even fireworks may be draped, attached, covered or arranged to provide a rigid star decoration. Both five- and six-pointed star versions are disclosed. The elements of the device are variously and pivotally interconnected, so that the device may be compactly collapsed for transportation or storage, and yet is easily collapsed and re-erected for repeated use from holiday to holiday.

A preferred embodiment of the apparatus of the invention is a decorative folding star constructed of star sections, which sections are straight but which may have slightly offset ends. When fastened together end to end, the sections form a continuous loop. Each star section is one half of one point of the star; thus a five-point star has ten sections, and a six-point has twelve sections. A five-point star could be made into a six-point star with the addition of two more sections. At the end of each section a fastener or connector is attached to allow for rotation, allowing the star to fold or collapse into a number of configurations. Decorative lights and/or light securing devices may be attached to the star sections. Interior support or connecting devices are attached to the inside angles of the star, and then connected to a center support column. The center support column holds the star in the desired shape and is used as a mounting device. Center supporting column fastening devices may be removable or sliding. The center supporting column is made of either round or square tubing with slightly larger pieces of the same material that slide up and down the column to adjust to the proper setting.

Thus, there is provided according to the invention a collapsible decorative star apparatus for erecting a collapsible five- or six-pointed star. Either embodiment comprises at least ten star sections, each section having two ends; some means for pivotally connecting each end of each star section with an end of another one of the star sections; a center support column; at least one collar slidably disposed upon the center support column; and at least four interior supports, at least two of the interior supports releasably connectable to the at least one collar, and disposable between the at least one collar and a corresponding one of the means for pivotally connecting. By these means, when the interior supports are connected to the collar, the collar is positionable upon the support column and the star sections are pivotal in relation to one another to arrange the sections in an array defining a star. When the interior supports are disconnected from the collar, the collar may be slid along the support column and the star sections are pivotal in relation to each other to collapse the star apparatus.

The means for pivotally connecting ideally comprises an eye aperture on each end of each of the star sections, and a threaded bolt releasably disposable through the aperture, wherein the bolt may be turned (for example through a corresponding nut) to loosen or tighten the pivotal connection means. The apparatus preferably further comprises some means, such as a set screw, for example, for releasably fixing the position of the at least one collar upon the center support column.

The preferred embodiment further features receiving tubes mounted upon the slidable collar for releasably receiving ends of the at least two interior supports, so that an end of each of the at least two interior supports can be snugly inserted into a corresponding one of the receiving tubes to hold the decorative star in the desired and erect configuration.

Preferably, the five-pointed version of the apparatus has two collars slidably disposed upon the central support column, and ten rigid star sections. In such instance, two of the interior supports are releasably connectable to a first one of the collars, and two others of the interior supports are releasably connectable to a second one of the collars. Also, there is some means, such as another set screw or the like, for releasably fixing the position of the second collar upon the center support column.

For a six-pointed embodiment of the apparatus, there preferably is a single collar slidably disposed upon the central support column, and twelve rigid star sections. Six interior supports, releasably attachable to the single collar, are pivotally connected to joints between certain of the star sections to hold the decorative star in its desired and erect configuration. Again, there is provided some means for releasably fixing the position of the collar upon the center support column.

In sum, the preferred embodiment of the apparatus of the invention is a collapsible decorative star apparatus comprising: ten star sections, each section having two ends; means for pivotally connecting each end of each star section with an end of another one of the star sections; a center support column; at least one collar slidably disposed upon the center support column; and at least four interior supports, at least two of the interior supports releasably connectable to the at least one collar, and disposable between the at least one collar and a corresponding one of the means for pivotally connecting. These components are all interconnected so that when the interior supports are connected to the at least one collar, the at least one collar is positionable upon the support column and the star sections are pivotal in relation to one another to arrange the sections in an array defining a five-pointed star; and wherein when the interior supports are disconnected from the collar, the collar may be slid along the support column and the star sections are pivotal in relation to each other to collapse the star apparatus.

A primary object of the present invention is to provide a decorative star that is durable and re-useable.

A primary advantage of the present invention is that it is easy to manufacture and easy to assemble.

Another advantage of the invention is that it is collapsible for transport and storage.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The invention is a decorative apparatus, specifically a decorative star. It may find ready use during holidays, especially Christmas or the United States of America Independence Day, when stars are a popular symbol. Nevertheless, the apparatus may find use at other times, especially at any time when an American patriotism is on display. A tremendous advantage of the invention is that it is easily re-useable, yet durable, and can be "folded" or collapsed for transportation and storage between uses.

Figure 1:
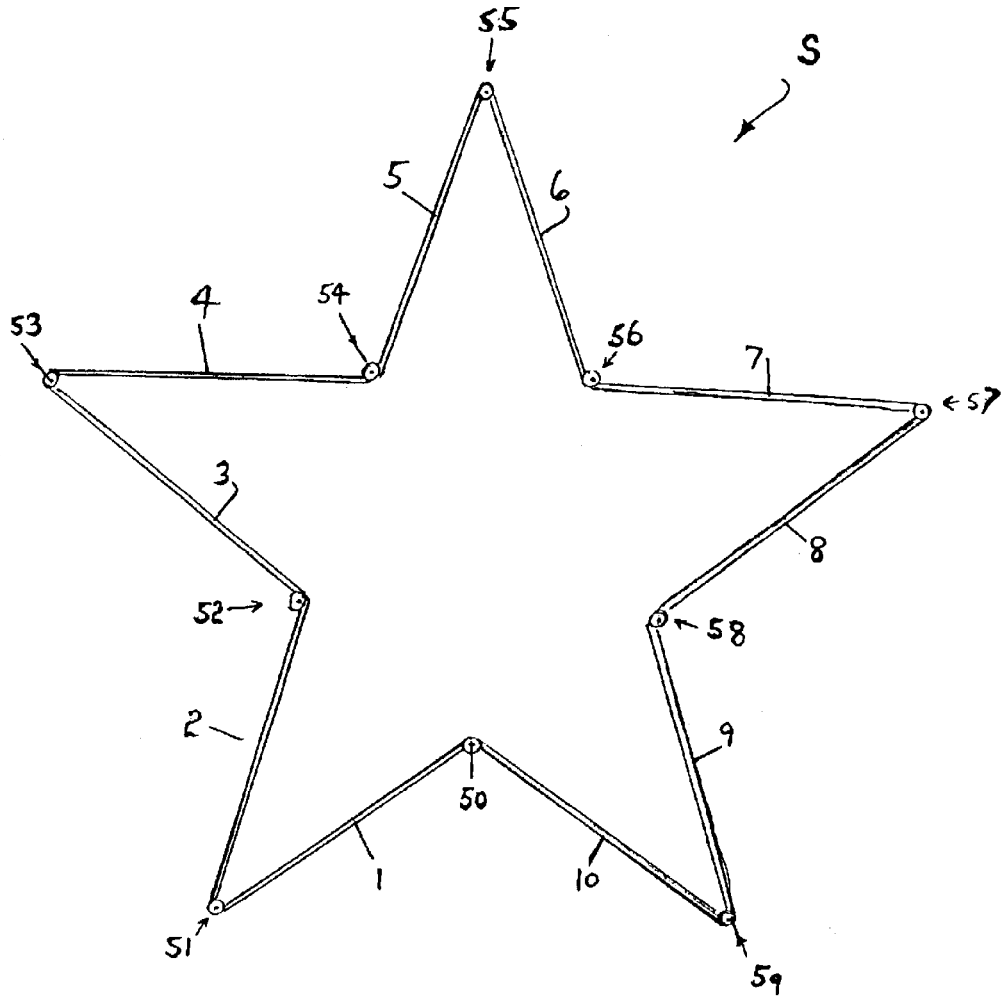
FIG. 1 is a view of the five-pointed star alone showing the star sections and connection joints.
Figure 2:
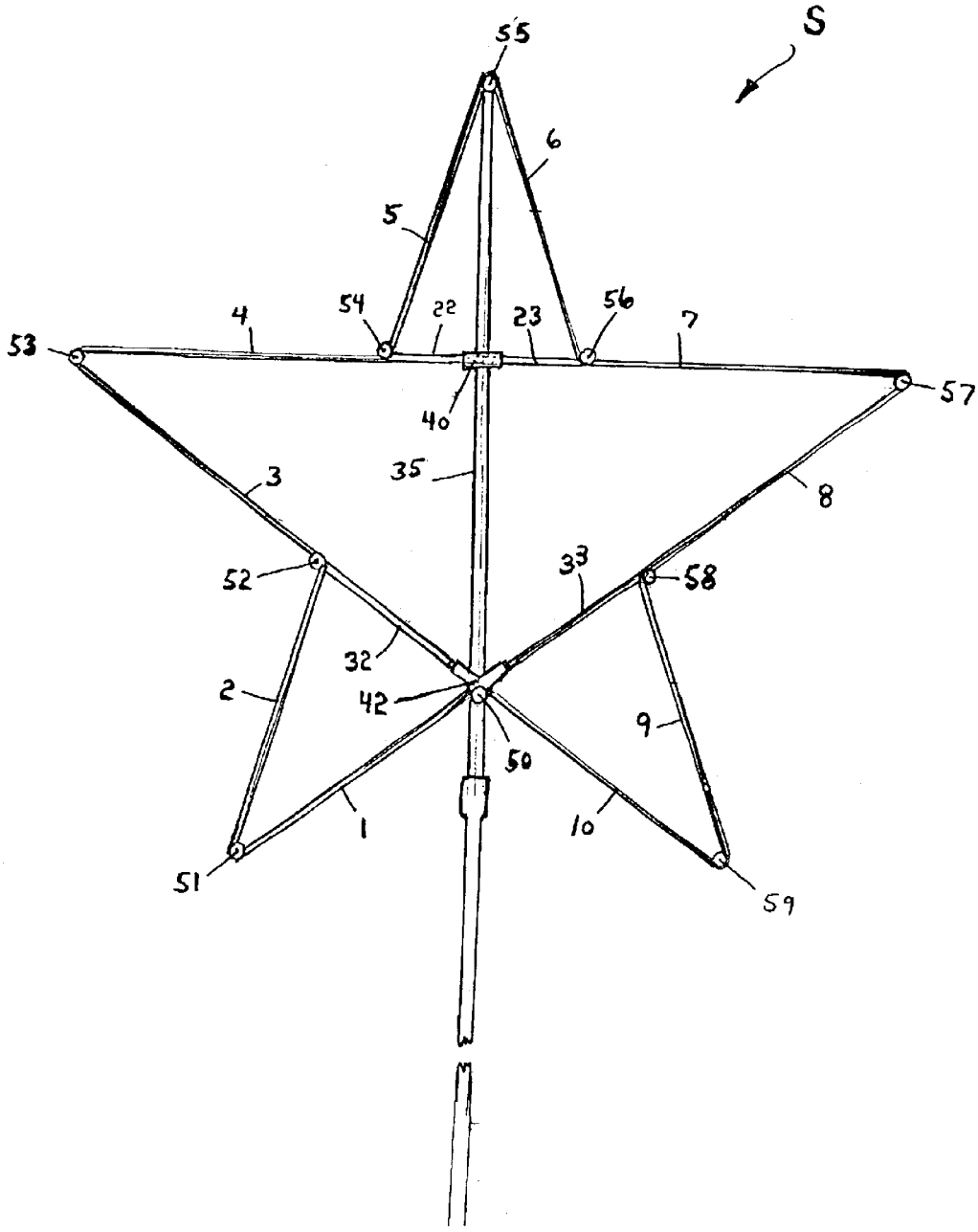
FIG. 2 is a view of the five-pointed star mounted on a center supporting column with internal supports.
Figure 2A:
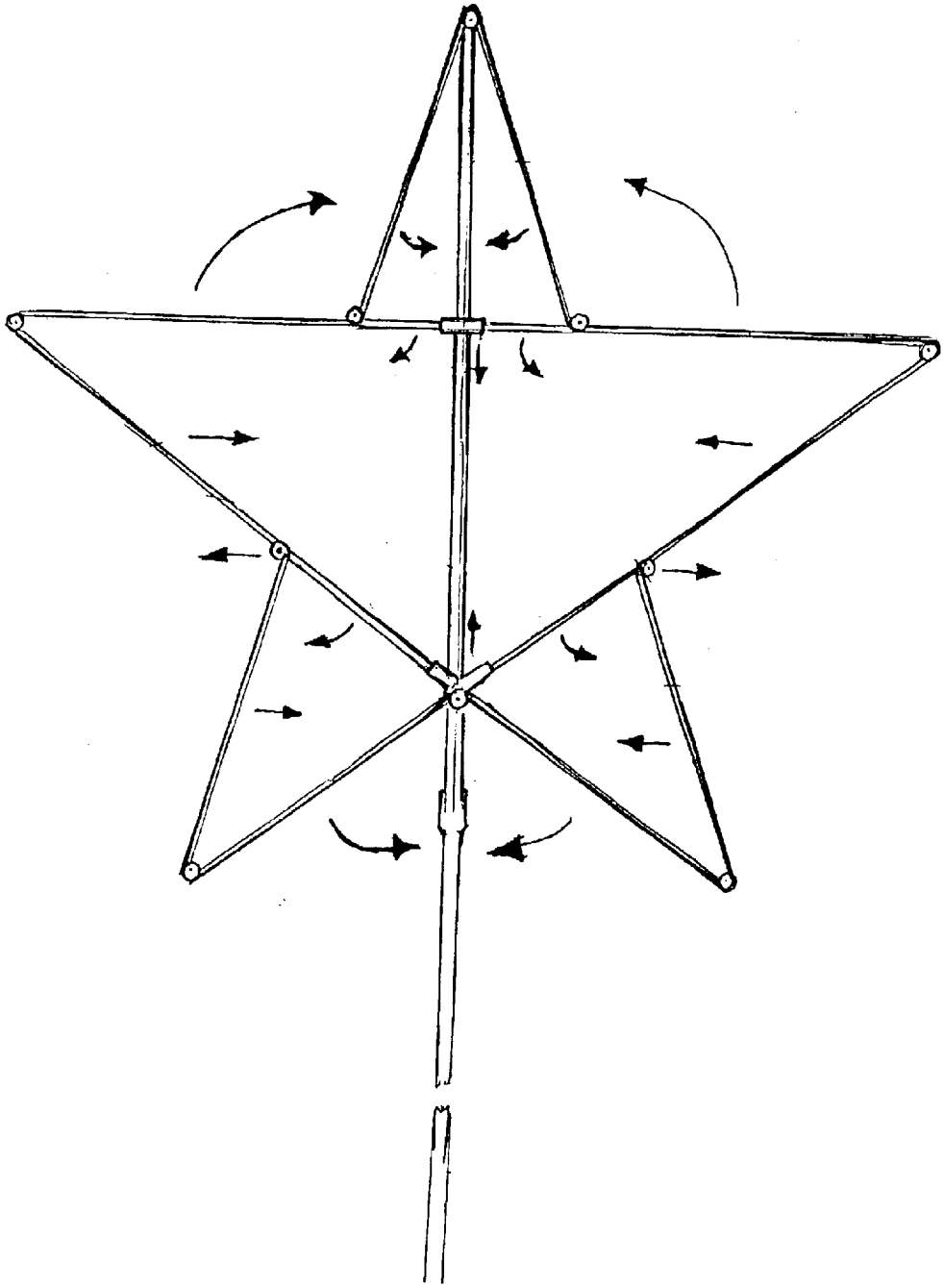
FIG. 2A is a view of the embodiment of FIG. 2, with directional arrows indicating how the various components may move in one manner of collapsing the star.

Attention is invited to the drawing figures, reference to which should be made in conjunction with this written specification. FIGS. 1, 2 and 2A provide overall depiction for a five-pointed star S, while FIGS. 3 and 4 offer a depiction of a six-pointed star SS. Description of the five-pointed embodiment S will be emphasized, as the assembly and function of the six-pointed embodiment SS will be largely and readily apparent, to one of ordinary skill in the art, from the description of the five-pointed embodiment. The apparatus of the invention can be made in practically any size, but it is contemplated that its advantages are most attractive when the star has a point-to-point dimension of, for example, three to five feet. The ends of the several star sections are connected so as to rotate or pivot to the desired angle needed to form a star comprising the desired number of points.

Referring to FIGS. 1 and 2, it is seen that the preferred embodiment of the apparatus includes ten star sections, labeled with reference numerals 1 through 10 respectively, two upper interior supports 22, 23 and two lower interior supports 32, 33, a center support column 35, and an upper collar 40 and a lower collar 42, the collars 40, 42 slidably disposed on the support column 35. The collars 40, 42 have added connection features thereon, as will be further described. The star sections 1–10 are deployable into an array defining a substantially "flat" star, as indicated in the figures, the various star sections essentially defining a single imaginary plane. The six-pointed alternative embodiment has twelve star sections and only one sliding collar (FIG. 4), but again, its function and use will be readily understood by one skilled in the art.

The apparatus may be crafted from a variety of materials, including plastics and lightweight metals and alloys, such as aluminum and the like. Fittings and connecters may be made from molded plastic, while the principal sections and support columns may likewise be fashioned from rigid plastic rods, or solid or hollow plastic or aluminum components. Materials generally will be selected with the goals of minimizing manufacturing costs, while optimizing durability—twin goals known in the art.

The various star sections 1–10 are connected, end-to-end, by means of pivotal connections labeled 50 through 59 respectively in FIGS. 1 and 2. Section connections 50–59 are of any suitable type, such as loop-and-pin type connections as suggested in FIGS. 7–16. Any type of pivotal connections may be used, the main aspect of the section connections being that any pair of adjacent, interconnected star sections are pivotal with respect to each other within a single plane; the pivoting of all the joints or connections 50–59 occurs in a common imaginary plane, so that the star itself preferably expands and collapses in substantially only two dimensions.

Figure 5:
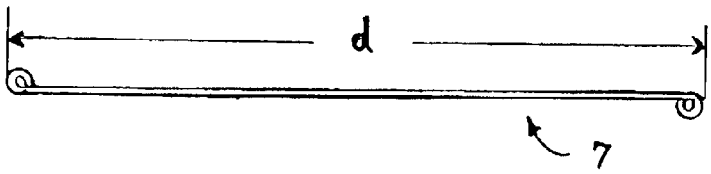
FIG. 5 is a plan view of a star section showing offset curled ends.

FIG. 5 shows a single star section, for example upper right section 7. The section 7 is straight, with a length d of, for example only, about 24 inches. Notably, all the basic star sections 1–10 preferably have about the same length d, and have generally the same configuration, which promotes inexpensive mass manufacture of the generally interchangeable star sections. Thus, in the preferred embodiment, each star section is essentially a duplicate of the others.

Figure 6:
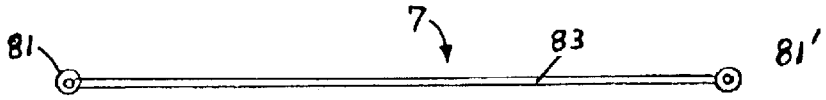
FIG. 6 is a plan view of a star section without offset ends.
Figure 7:
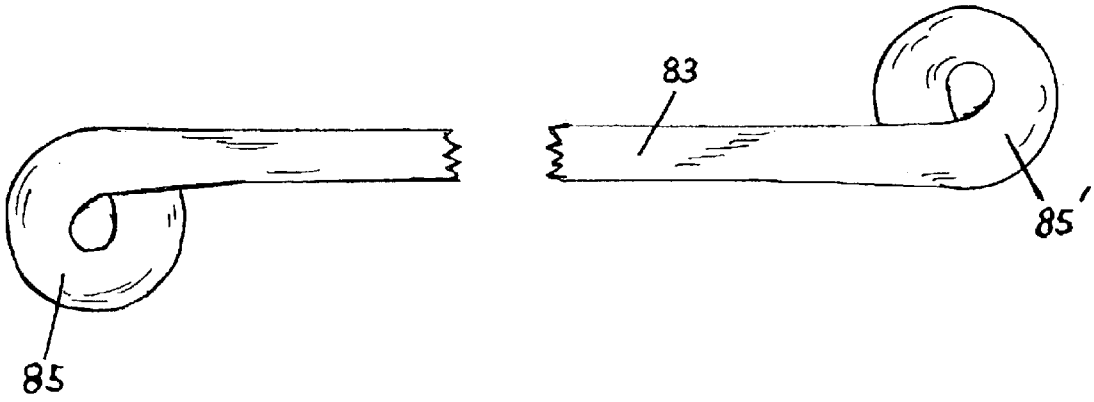
FIG. 7 is an enlarged plan view of a star section with ends offset and flattened.

FIG. 6 and enlarged FIG. 7 illustrate that each end of each respective star section 1–10 has a loop or an eye 81, 81". The eye portions 81, 81" define an aperture therein through which a bolt may be passed thereby to configure the pivotal joints or connections 50–59 seen in FIG. 2. FIG. 7 shows that each star section optionally may comprise a single rod or shaft having a straight portion 83 with integral curled portions 85 bent to define the eye portions 81, 81".

Figure 8:
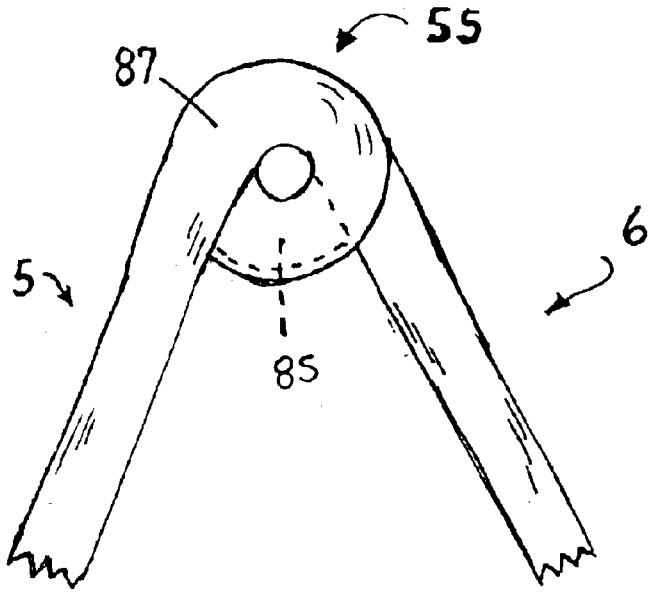
FIG. 8 is a plan view illustrating how the point angle would appear before placing the fastening device through the hole.
Figure 9:
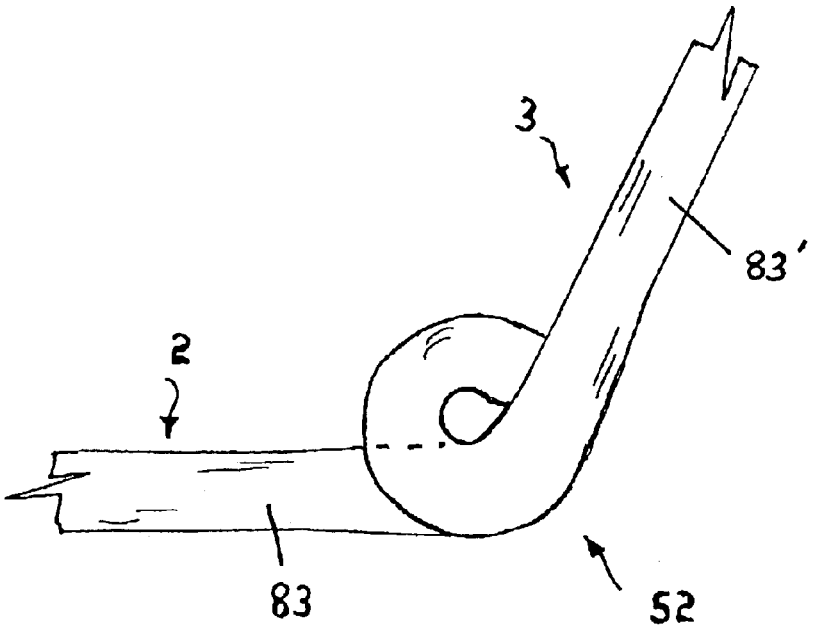
FIG. 9 is a plan view of how an internal angle would appear before placing the fastening device through the hole.

FIG. 8 is an exemplar showing of how the eye portions 85, 87 of, for example, star sections 5 and 6 can be overlapped to define a single bolt aperture at the point of connection 55 seen in FIG. 2. Similarly, the straight portions 83, 83" of the sections 2 and 3 may define overlapping eye portion to partially comprise the joint 52 as seen in FIG. 2.

Figure 10:
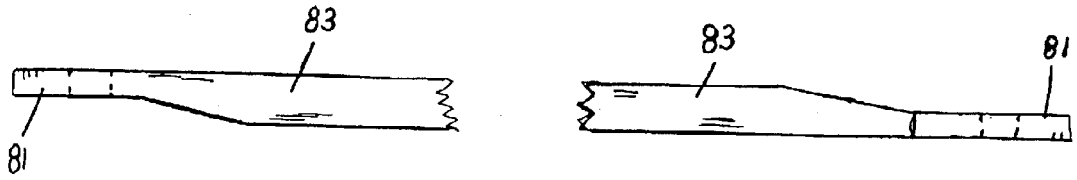
FIG. 10 is a side view of the flattened ends of a star section.
Figure 11:
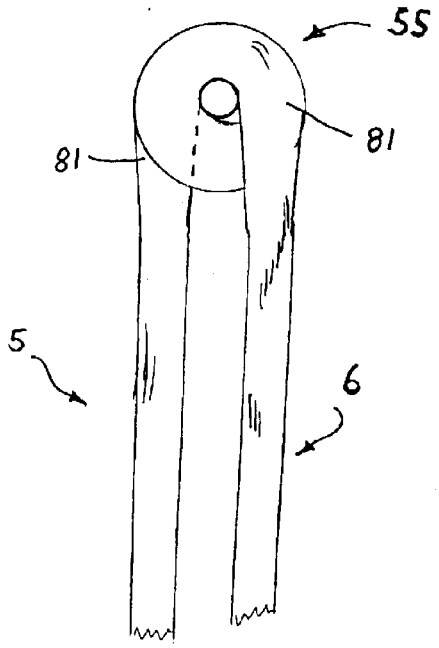
FIG. 11 is a plan view of a point angle after folding.
Figure 12:
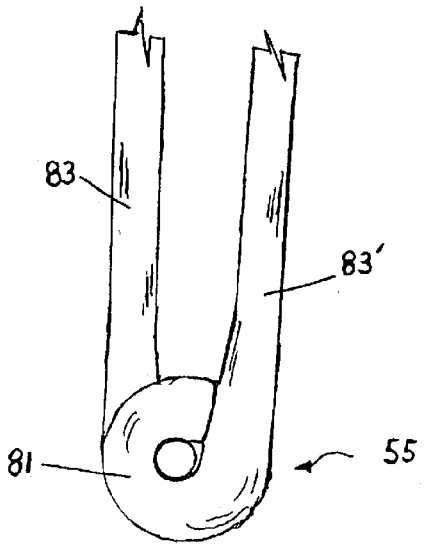
FIG. 12 is a plan view of an interior angle after folding.
Figure 13:
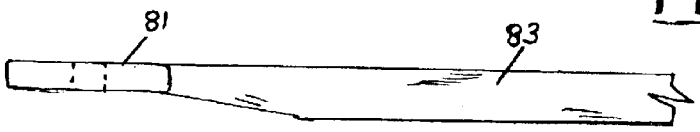
FIG. 13 is a side view of an end of a star section.
Figure 14:
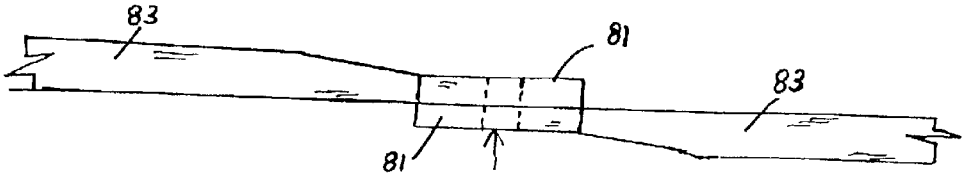
FIG. 14 is a side view of two end of an adjacent pair of star sections, arranged for connection.
Figure 15:
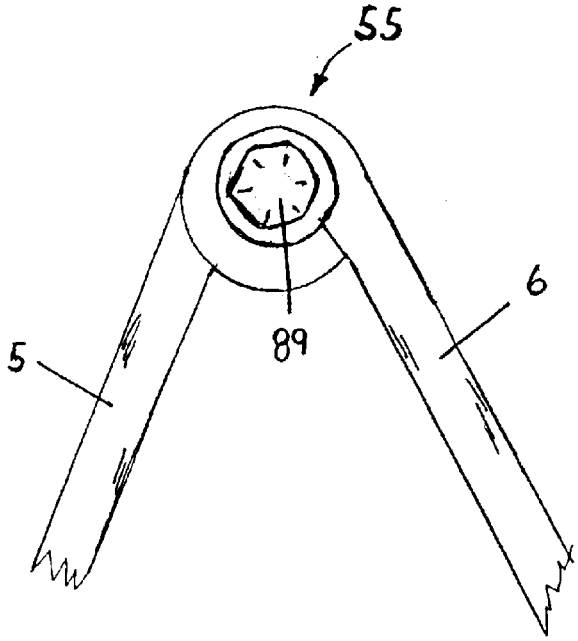
FIG. 15 is a plan view of a point angle, with two sections placed together with connecting device.
Figure 16:
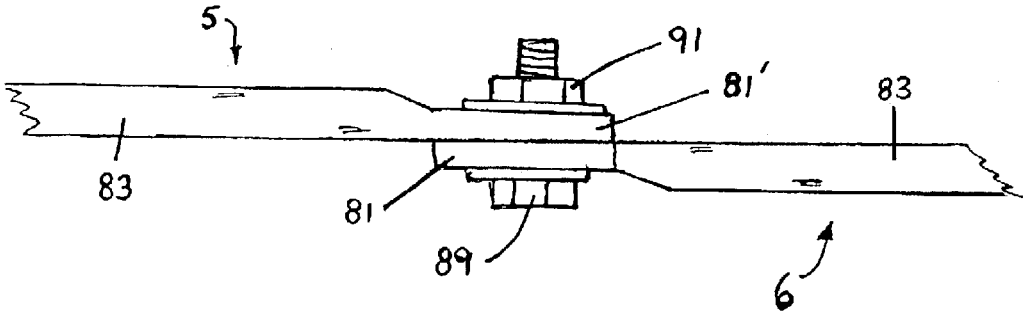
FIG. 16 is a side view of two sections placed together with fastening device.

Combined reference is made to FIGS. 10–16, also illustrating one preferred configuration of the ends of the star sections 1–10 to permit their interconnection to comprise the pivotal joints or connections 50–59. Each end of a star section has an eye portion 81, 81", which preferably manifests a flattened profile relative to the straight body portion 83, as best indicated in FIGS. 10 and 13. These flattened eye portions 81, 81" may be overlapped with their bolt apertures aligned in registration (FIGS. 11, 12 and 14), as previously explained, to define the loop aspect of a loop-and-pin connection. With the insertion of a threaded bolt 89 and nut 91 combination (preferably also with a washer on each side of the joint) a pivotal connection 55 is constituted as indicated in FIGS. 15 and 16. By controllably loosening or tightening the bolt-and-nut combination, the pivotability of the joint connection 55 may be regulated according to an advantage of the invention.

Thus, while each of the star sections is substantially straight, its end eye portion may be offset and flattened, to enhance folding and stability and to allow for the addition of a decorative lighting system without interference. Each star section may be fashioned, for example, from one-fourth-inch diameter rod or tube curled and flattened at each end as indicated in the figures. Other known and suitable modes of providing a pin- or bolt-receiving aperture at each end of the star section may be utilized.

Figure 17:
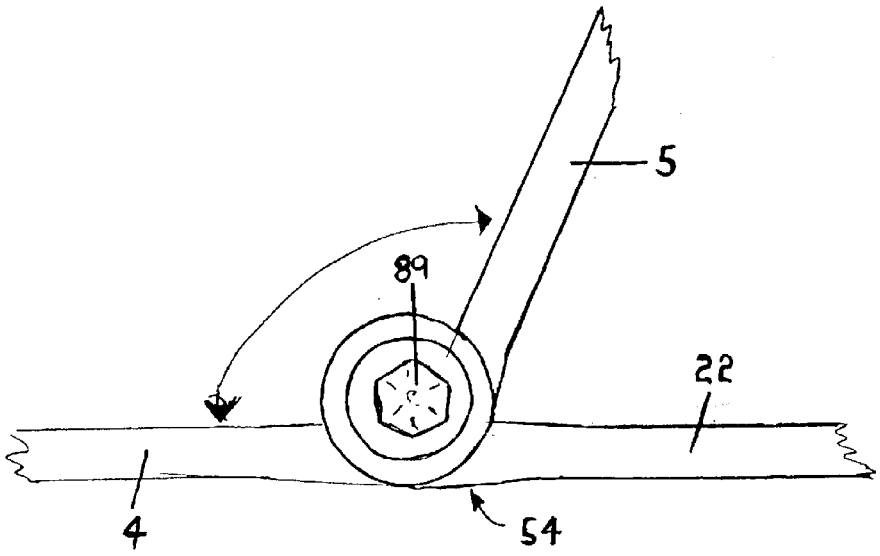
FIG. 17 is a plan view of an internal angle with connecting device and interior support in place, with a fastening device inserted.
Figure 18:
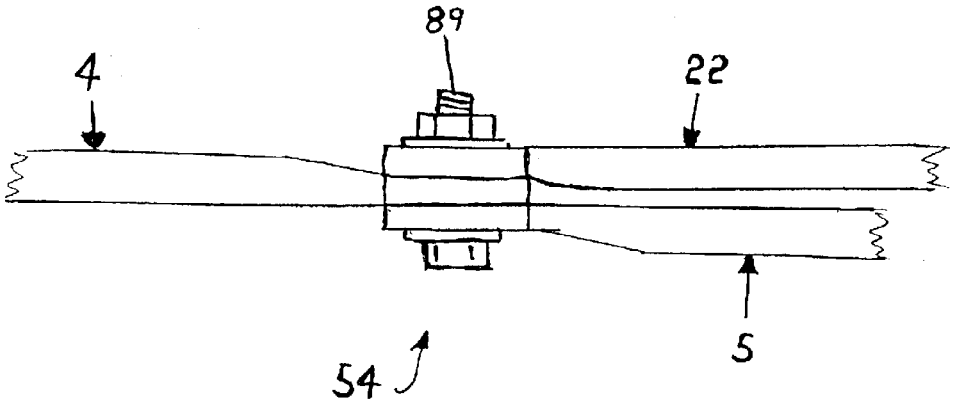
FIG. 18 is a side view of an internal angle with fastening device and interior support in place, with a fastening device inserted.

FIGS. 17 and 18 provide added description of the configuration of the tri-part connections 52, 54, 56 and 58 seen in FIG. 2. Each of these particular pivotal joints are characterized by the junction of two adjacent star sections, as well as one of the two upper interior supports 22, 23 or two lower interior supports 32, 33. For example, as seen in FIGS. 17 and 18, one star section (e.g. 4) is pivotally joined to an adjacent star section (e.g. 5) and an upper interior support 22. The connection 54 (FIG. 2) thus is assembled generally in the same manner as the two-part junctions described above, except the three elements share a common bolt 89 as a pivot pin.

Figure 19:
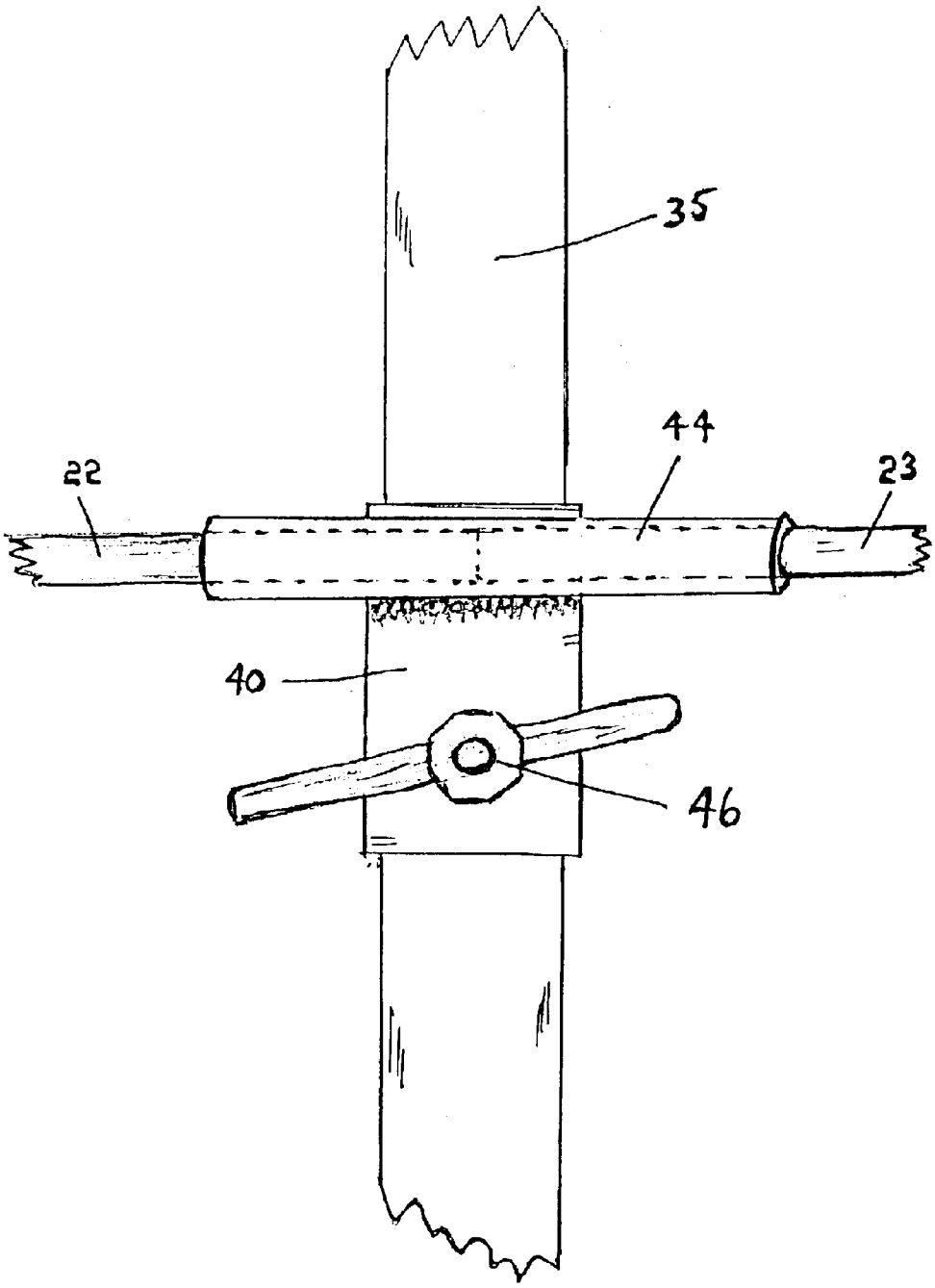
FIG. 19 is an enlarged front view of the upper collar slidably disposed upon the central supporting column.
Figure 20:
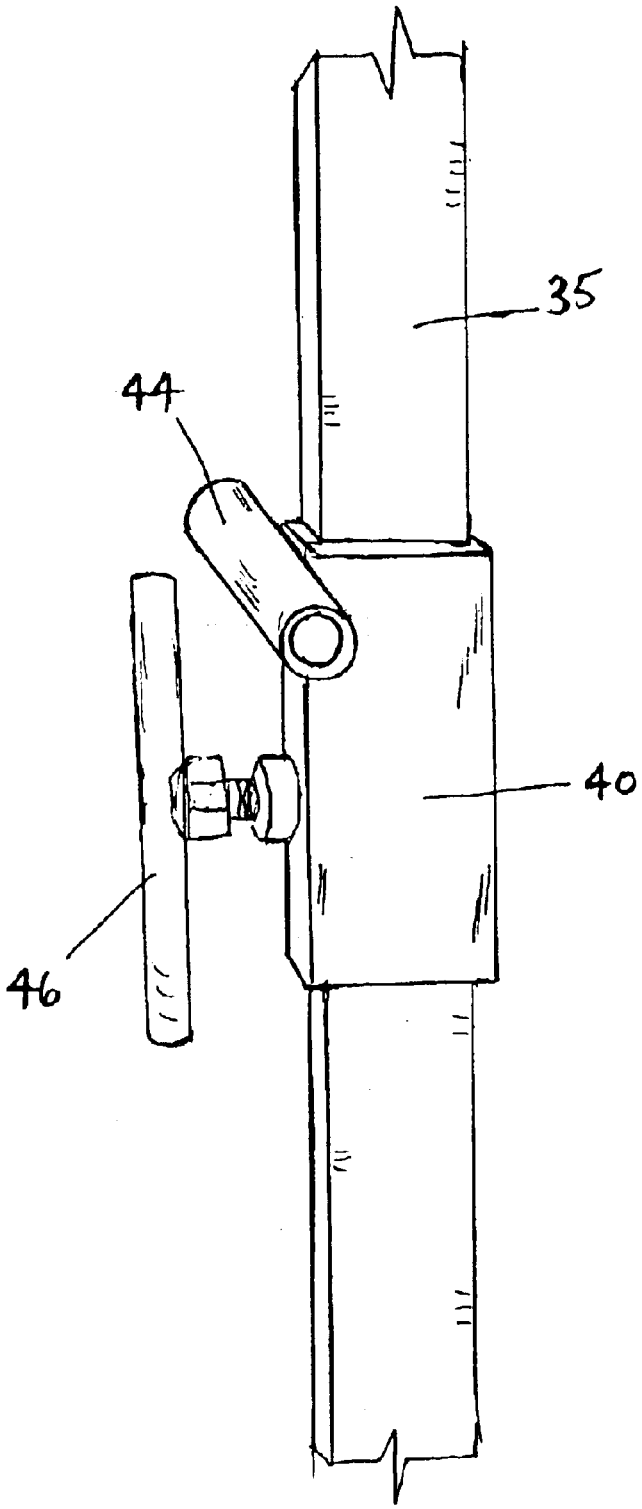
FIG. 20 is a side perspective view of the embodiment seen in FIG. 19.

FIGS. 19 and 20 offer enlarged views of the upper collar 40, which has an interior passageway adapted to receive the support column 35 for sliding engagement between the column 35 and the collar 40. Support column 35 is illustrated to be a rigid brace with a square cross section, and may be a square hollow tube, but is not so limited and may alternatively have a circular cross section. As seen in the figures, the upper collar 40 has securely mounted thereon a horizontal receiver tube 44 open at both ends. Receiver tube 44 is sized and adapted to receive the distal ends of the upper interior supports 22, 23, and thus serves to reversibly connect the interior supports to the collar 40. Upper collar 40 also is provided with a manually operable set screw or bolt 46, of conventional character, which is selectively engageable with the support column 35 to temporarily prevent the collar 40 from sliding up or down on the column 35.

Figure 21:
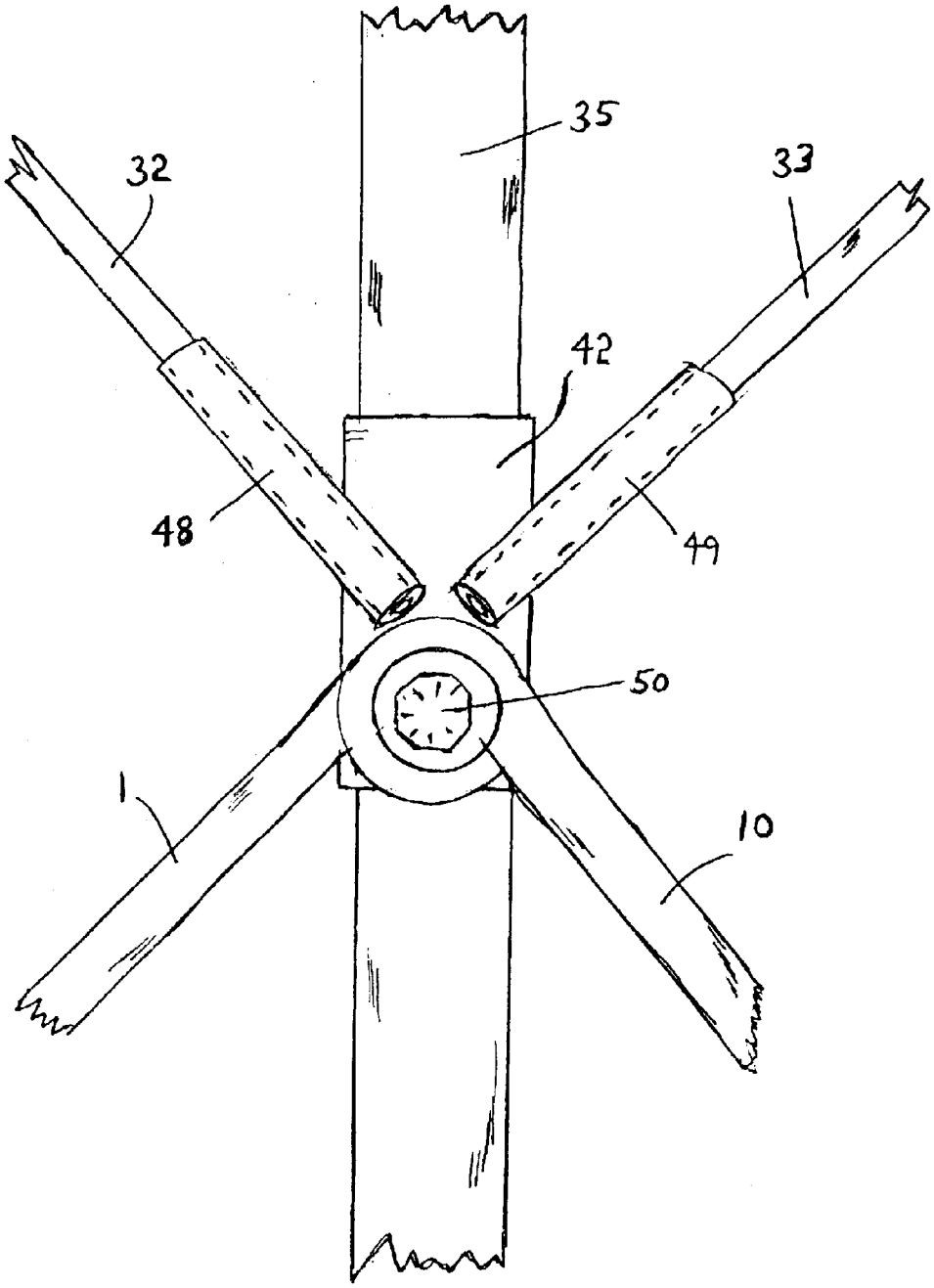
FIG. 21 is a front view of the lower collar slidably disposed upon the supporting column.
Figure 22:
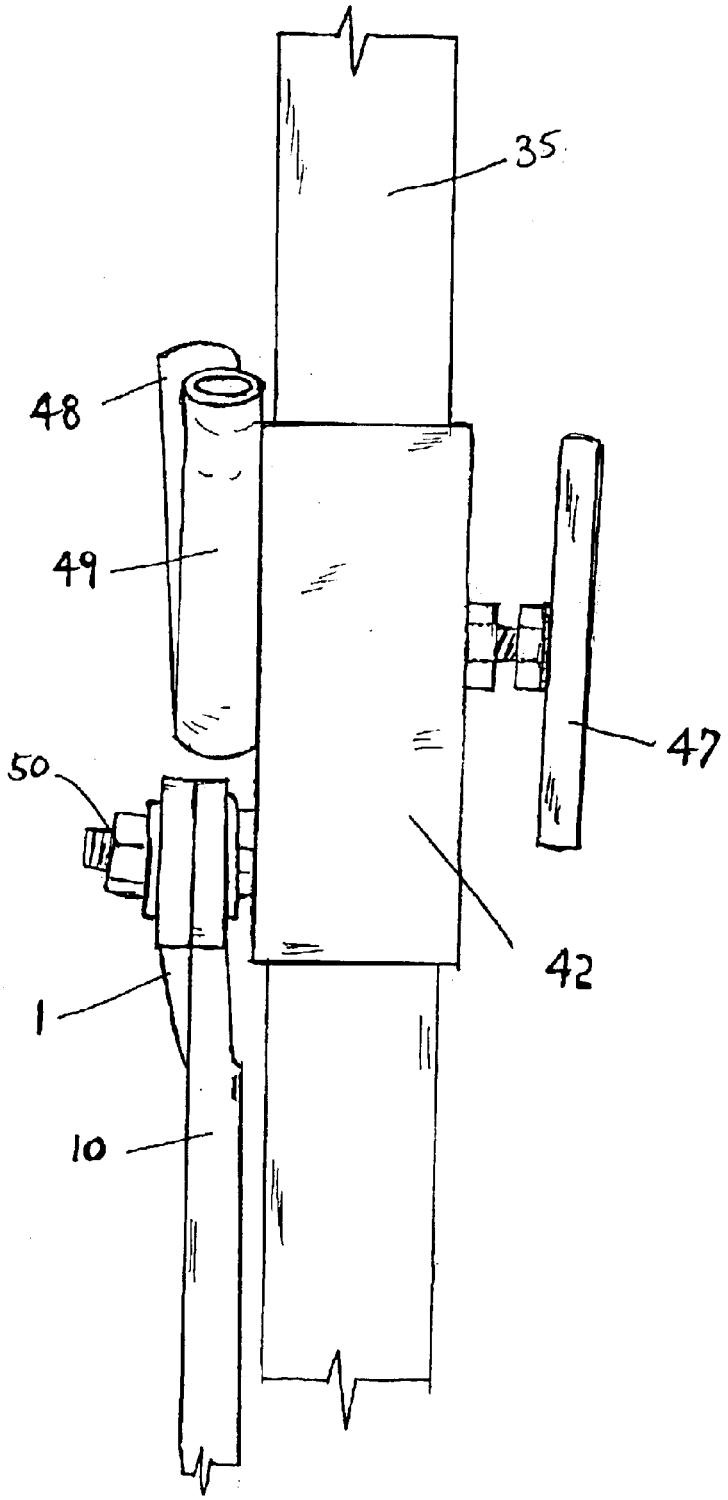
FIG. 22 is a side perspective view of the lower collar seen in FIG. 21.

FIGS. 21 and 22 are views of the lower collar 42, which also is slidably movable up and down on the column 35. Lower collar 42 likewise is provided with a set screw 47 or the like engageable against the column 35 to selectively temporarily fix the collar 42 against sliding along the column 35. Lower collar 42 has a pair of rigidly mounted receiver tubes 48, 49 arranged thereon on a V-shaped configuration, each tube 48, 49 having an inclined disposition with its outward open end facing upward, as seen in FIGS. 2, 21, and 22. The upper open ends of the lower receiver tubes 48, 49 are sized and adapted to receive the distal ends of corresponding ones of the lower interior supports 32, 33. It is also seen that the first connection 50 between the first 1 and last 10 star sections also has a pivotal attachment with the lower collar 42, such that the the movement and positioning of the lower collar 42 simultaneously affects the relative positions of those star sections 1, 10.

References herein to the use of set screws also are intended to include known and yet unknown equivalents, such as controllable spring-biased detent systems, for example, known in the art for use in securing a tubular collar around a rod or shaft inserted there-through.

With continuing resort to the drawing figures, it is noted that the top connection 55 preferably has pivotal attachment to the top end of the support column 35, so that the proximate ends of the star sections 5 and 6 are attached to the top of the column 35 and yet are free to rotate, with respect to each other, about the connection 55. Similarly, the first and last star sections 1 and 10 have proximate ends that pivot around the connection 50, which joint is attached to the lower collar 42.

The upper interior supports 22, 23 have their proximate ends pivotally connected to the connections 54, 56, so that the upper interior support 22 and the star sections 4 and 5 are all mutually pivotal about the connection 54, and the upper interior support 23 and the star sections 6 and 7 are all mutually pivotal around connection 56.

The star apparatus can be collapsed from the position shown in FIG. 2 by the expedient of loosening the set screws 46 and 47 to permit the collars 40, 42 to slide along the support column 35. Combined reference is made to FIGS. 2 and 2A in this regard; FIG. 2A depicts directional arrows indicating the movement of the various component parts during the process of collapsing the star. The star is erected by reversing the collapsing process. The upper collar 40 can be slipped downward slightly, which will permit the distal ends of the upper interior supports 22, 23 to be withdrawn from the upper receiver tube 44 by pivoting the upper interior supports 22, 23 around connections 54, 56. Continued downward sliding of the upper collar 40 along column 35 allows the sections 3–8 to pivot around connections 52–58 to induce the collapse f the star. The process of collapsing the star is fostered by also extracting the distal ends of the lower interior supports 32, 33 from their gravity/frictional engagement within corresponding lower receiver tubes 48, 49, which may be accompanied by simultaneous pivoting of the lower interior supports 32, 33 around connections 52, 58 (as well as pivoting star sections 2 and 3 around connection 52, and sections 8 and 9 around connection 58). Also, the release of the set screw 47 allows the lower collar 42 to slide upward along the column 35, to permit rotating collapse of the star sections 1, 2, 9 and 10.

Still referring especially to FIGS. 2 and 2A, the complete collapse of the star is realized by sliding the collars 40, 42 toward each other. After removing the lower interior supports 32, 33 from the lower receiver tubes 48, 49, the lower collar slides upward, and as the lower collar 42 slides, the star sections 1 and 10 pivot about connection 50 and are folded parallel against the column 35. After removing the upper interior supports 22, 23 from the upper receiver tube 44, the upper collar slides upward, and as the upper collar 40 slides, star sections 5 and 6 pivot about connection 55 and are folded parallel against the column 35. Simultaneously, the connectors 52 and 58 translate outward away from the column 35, as the particular sections 2 and 3 pivot around connection 52 and star sections 8 and 9 pivot around connection 58. Sections 2 and 3 pivot until they are substantially aligned collinear, and sections 8 and 9 are pivoted until they line up collinearly. Aligned star sections 2 and 3 are then drawn against and parallel to the column 35 by folding section 4 inward and upward toward the column 35 while folding section 1 inward and downward toward the supporting column. Likewise, the aligned sections 8, 9 are drawn parallel against the supporting column 35 by simultaneously folding the section 7 inward and upward toward the column and section 10 inward and downward toward the column.

Thus collapsed, a five-foot star can be carried or stored in a container only about four to six inches square and little more than 5 feet long.

The star is erected for use by simply reversing the collapsing process. The star is laid on a supporting surface, and the collar 40 (with set screw released) is moved along the column 35 until star section 4 is nearly collinear with section 7, at which time the upper interior supports 22, 23 are pivoted into position to insert their distal ends snugly into the upper receiver tube 44. As the user guides the supports 22, 23 into the upper receiver tube 44, he simultaneously selectively adjusts the position of the upper collar 40 until the sections 4 and 7 and the upper interior supports 22, 23 are all collinear, as seen in FIGS. 2 and 2A. The upper interior supports 22, 23 maintain the sections 4 and 7 (and thus the sections 5 and 6 as well) in the extended condition. The upper set screw 46 can then be tightened to temporarily but securely fix the collar 40 in position upon the column 35.

Similarly, the lower collars 42 (with set screw released) is moved along the column 35 until star section 3 is nearly collinear with section 10, and section 1 is about collinear with section 8, at which time the lower interior supports 32, 33 are pivoted into position to insert their distal ends snugly into the lower receiver tubes 48, 49. As the user guides the supports 32, 33 into the lower receiver tubes 48, 49, he simultaneously selectively adjusts the position of the lower collar 42 until the sections 3 and 10 and the lower interior support 32 are all collinear, as seen in FIGS. 2 and 2A. Star sections 1 and 8 will also be collinear with the other lower interior support 33, also as seen in FIGS. 2 and 2A. The lower interior support 32, 33 maintain the sections 3 and 8 (and thus the sections 2 and 9 as well) in the extended condition. The user then tightens the set screw 47 to temporarily but securely fix the lower collar 42 in position upon the column 35.

The various star sections 1–10 are so proportioned as to present an aesthetic, bilaterally symmetrical star. Notably, the preferred embodiment of the five-pointed star, when fully erected, has star sections 2 and 5 collinear (although not connected to each other), and sections 6 and 9 collinear (but not directly connected).

Figure 3:
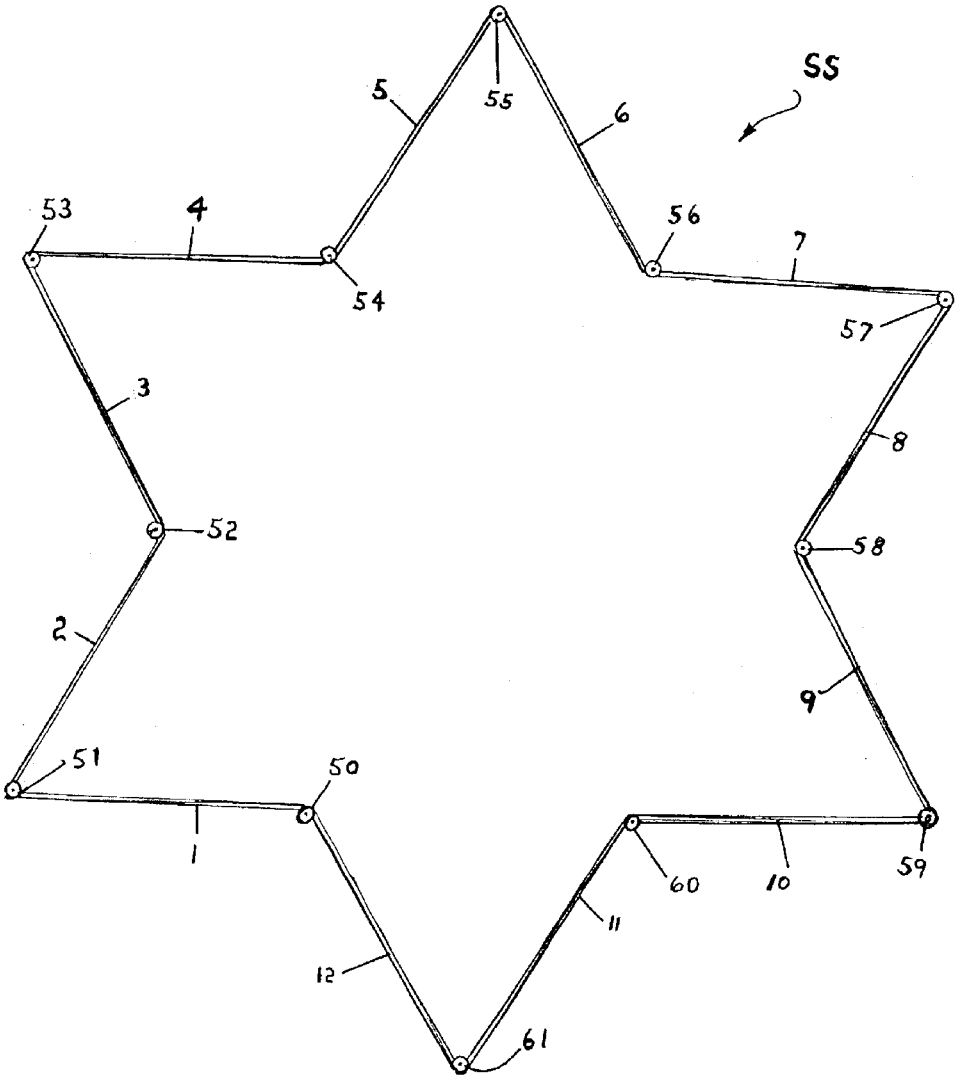
FIG. 3 is a view of a six-pointed star alone showing the sections and connection joints.
Figure 4:
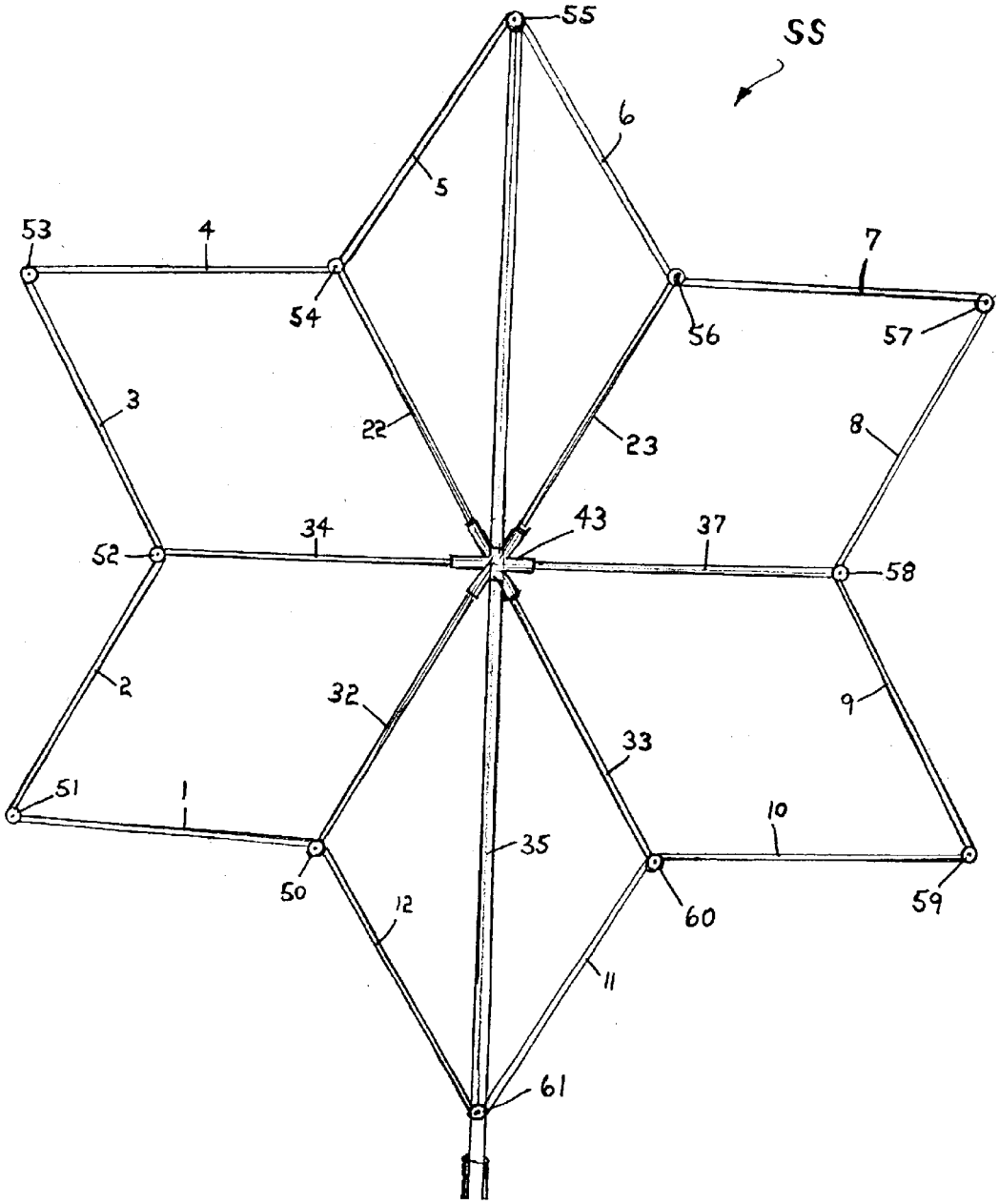
FIG. 4 is a view of the six-pointed star showing the center supporting column and interior sections.

FIGS. 3 and 4 illustrate a six-pointed star, which is erected and collapsed in a similar manner, except that only one central clamping collar 43 is utilized. Reference to FIGS. 3 and 4 show how a six-pointed star SS may be assembled. The star SS has twelve star sections 1–12, the end of each section being pivotally connected to the corresponding end of an adjacent section by means of the several connection joints 50–61 which are the same in form and function as the connections 50–59 described for the five-pointed embodiment S of FIGS. 1 and 2. The six pointed embodiment SS has a single central collar 43 slidably disposed on, and releasably securable to, the central support column 35 similar to the column already described. The six-pointed embodiment SS has six interior support members 22, 23, 32, 33, 34 and 37, which extend from the collar 43 to corresponding pivotal connection joints 54, 56, 52, 58, 50, and 60 in a manner substantially the same as heretofore described for the interior supports 22, 23 and 32, 33 for the five-pointed embodiment. The mode of pivotally attaching the interior support members 22, 23, 32, 33, 34 and 37 is readily understood by reference to FIGS. 17 and 18. The proximate ends of the interior support members 22, 23, 32, 33, 34 and 37 are removably insertable into six equally spaced, radially arrayed receiver tubes fixed upon the central collar 43, as suggested in FIG. 4.

It is evident, therefore, that the six-pointed embodiment of the star SS may be erected (or collapsed) by inserting (or removing) the proximate ends of the interior support members 22, 23, 32, 33, 34 and 37 into (or from) the central collar 43, pivoting the star various star sections 1–12 into (or out of) the configuration seen in FIG. 3 or 4, tightening (or loosening) the bolts at each of the connection joints 54, 56, 52, 58, 50, and 60, and tightening or loosening the set screw (not shown) in the collar 43 to fix or release the position of the collar 43 upon the column 35.

Reference to the figures, for example FIG. 2, shows that the support column 35 optionally may have several segments that can be serially aligned and inserted, in a conventional "tent pole" type of male-end-to-female-end manner, to provide a support column of substantial length/height when fully assembled, but yet which can be broken down into manageable length segments for transport and storage.

The pivotal connection between adjoining pairs of sections permits the erection and collapse of the star according to the afore-described steps to be performed rapidly and easily, and mainly through the manipulation and adjustment of the collars 40, 42 and interior supports 22, 23, 32, 33. Erection and collapse is accomplished with only a minimal amount of direct manipulation of the sections 1–10 themselves.

An advantage of the preferred embodiment of the invention is that in the collapsed state, the sections of the star 1–10, the interior supports 22, 23, 32, 33, and the central support column 35 remain interconnected. Separate, loose parts are minimized or eliminated. This helps eliminate the loss of parts during storage or transport.

The erected star may be displayed by inserting the vertical support column 35 into the ground, or into an appropriately legged stand or the like, such as those commonly used for flagpoles and umbrellas. Once on display, the star may be decorative in its own right, or may be decked and festooned with colored paper or fabric, and/or electric lights, or the like.

Although the invention has been described in detail with particular reference to these preferred embodiments, other embodiments can achieve the same results. Variations and modifications of the present invention will be obvious to those skilled in the art and it is intended to cover all such modifications and equivalents.

What is claimed is:

1. A collapsible decorative star apparatus comprising:

at least ten star sections, each said section having two ends;

means for pivotally connecting each end of each said star section with an end of another one of said star sections;

a center support column;

at least one collar slidably disposed upon said center support column; and at least four interior supports, at least two of said interior supports releasably connectable to said at least one collar, and disposable between said at least one collar and a corresponding one of said means for pivotally connecting;

wherein when said interior supports are connected to said collar, said collar is positionable upon said support column and said star sections are pivotal in relation to one another to arrange said sections in an array defining a star; and wherein when said interior supports are disconnected from said collar, said collar may be slid along said support column and said star sections are pivotal in relation to each other to collapse said star apparatus.

2. An apparatus according to claim 1 wherein said means for pivotally connecting comprises an eye aperture on each end of each of said star sections, and a bolt releasably disposable through said aperture, wherein said bolt may be turned to loosen or tighten the pivotal connection means.

3. An apparatus according to claim 1 further comprising means for releasably fixing the position of said at least one collar upon said center support column.

4. An apparatus according to claim 1 further comprising receiving tubes mounted upon said slidable collar for releasably receiving ends of said at least two interior supports; wherein an end of each of said at least two interior supports is snugly insertable into a corresponding one of said receiving tubes.

5. An apparatus according to claim 1 comprising:

two collars slidably disposed upon said central support column; and ten rigid star sections.

6. An apparatus according to claim 5 wherein two of said interior supports are releasably connectable to a first one of said collars, and two others of said interior supports are releasably connectable to a second one of said collars.

7. An apparatus according to claim 6 further comprising means for releasably fixing he position of said second collar upon said center support column.

8. An apparatus according to claim 1 comprising:

a single collar slidably disposed upon said central support column; and twelve rigid star sections.

9. An apparatus according to claim 8 comprising six interior supports releasably attachable to said single collar.

10. An apparatus according to claim 9 further comprising means for releasably fixing the position of said collar upon said center support column.

11. A collapsible decorative star apparatus comprising:

ten star sections, each said section having two ends;

means for pivotally connecting each end of each said star section with an end of another one of said star sections;

a center support column;

at least one collar slidably disposed upon said center support column; and at least four interior supports, at least two of said interior supports releasably connectable to said at least one collar, and disposable between said at least one collar and a corresponding one of said means for pivotally connecting;

wherein when said interior supports are connected to said at least one collar, said at least one collar is positionable upon said support column and said star sections are pivotal in relation to one another to arrange said sections in an array defining a five-pointed star; and wherein when said interior supports are disconnected from said collar, said collar may be slid along said support column and said star sections are pivotal in relation to each other to collapse said star apparatus.

12. An apparatus according to claim 11 wherein said means for pivotally connecting comprises an eye aperture on each end of each of said star sections, and a bolt releasably disposable through said aperture, wherein said bolt may be turned to loosen or tighten the pivotal connection means.

13. An apparatus according to claim 12 further comprising receiving tubes mounted upon said slidable collar for releasably receiving ends of said at least two interior supports; wherein an end of each of said at least two interior supports is snugly insertable into a corresponding one of said receiving tubes.

14. An apparatus according to claim 13 comprising two collars slidably disposed upon said central support column.

15. An apparatus according to claim 14 wherein two of said interior supports are releasably connectable to a first one of said collars, and two others of said interior supports are releasably connectable to a second one of said collars.

16. An apparatus according to claim 15 further comprising means for releasably fixing the positions of said two collars upon said center support column.

* * * * *